United States Patent [19]

Ackermann et al.

[11] 4,055,876

[45] Nov. 1, 1977

[54] SLIDER FOR INVISIBLE-TYPE SLIDE FASTENER

[75] Inventors: Walter Thomas Ackermann, Watertown; Jeremias Anthony Martins, Wolcott, both of Conn.

[73] Assignee: Scovill Manufacturing Company, Waterbury, Conn.

[21] Appl. No.: 693,422

[22] Filed: June 7, 1976

[51] Int. Cl.[2] ..... A44B 19/30

[52] U.S. Cl. ..... 24/205.14 R; 24/205.15 E; 24/205.1 R

[58] Field of Search ..... 24/205.14 R, 205.15 E, 24/205.1 R

[56] References Cited

U.S. PATENT DOCUMENTS

| | | | |
|---|---|---|---|
| 2,181,142 | 11/1939 | Marinsky | 24/205.14 R |
| 3,004,318 | 10/1961 | Weiser | 24/205.15 E |
| 3,419,943 | 1/1969 | Heimberger | 24/205.14 R |
| 3,602,958 | 9/1971 | Glindmeyer | 24/205.14 R |

FOREIGN PATENT DOCUMENTS

| | | | |
|---|---|---|---|
| 979,306 | 4/1951 | France | 24/205.14 R |
| 2,202,605 | 7/1973 | Germany | 24/205.14 R |
| 1,806,239 | 5/1970 | Germany | 24/205.14 R |
| 309,535 | 11/1955 | Switzerland | 24/205.14 R |
| 1,215,690 | 12/1970 | United Kingdom | 24/205.14 R |

*Primary Examiner*—Bernard A. Gelak
*Attorney, Agent, or Firm*—Dallett Hoopes

[57] ABSTRACT

A slide fastener slider has body and diamond preferably of molded plastic parts. The parts are held together in snapfastener fashion. Typically, the slider body carries a head and the diamond an opening or socket. Molded integrally with the diamond is an arching locking arm and a pull tab is provided preferably formed of a pair of cords with spaced crosspieces. The tab is provided with an anchoring end adapted to be trapped under inward flanges at the top of the socket opening, one of the crosspieces being disposed under the locking arm to raise the arm during the pulling of the pull tab. The aforementioned anchoring end prevents overtaxing the locking arm, absorbing the pulling force beyond a preset limited amount borne by the arm.

13 Claims, 7 Drawing Figures

SLIDER FOR INVISIBLE-TYPE SLIDE FASTENER

BACKGROUND OF THE INVENTION

1. Field of the Invention

This invention relates to a slider having a slide fastener. More specifically, this invention relates to a slider for an invisible-type slide fastener, the slider having at least one part made of molded plastic.

2. Description of the Prior Art

The prior art is replete with examples of slide fastener sliders of various descriptions. Some are designed especially for use with so-called "invisible" slide fasteners wherein the fastener elements are sewn to the rear face of the garment panels adjacent the opening and are substantially invisible when the opening is closed. An example of such a slider is shown in the U.S. Pat. No. 3,757,391 to Cuckson et al, assigned to our assignee. While the aforementioned patent disclosed a meritorious slider, the present invention is an improvement thereover with respect to improved ease of manufacture and locking characteristics.

The prior art also includes U.S. Pat. No. 3,011,251 to MacNamara wherein a slider for an invisible slide fastener is disclosed. Such prior devices, however, require special pin means to attach the parts together and lack means to lock the slider from traveling along the fastener elements when it is desired that it not do so.

SUMMARY OF THE INVENTION

The present invention relates to a slide fastener slider for an invisible-type fastener having a more or less conventional body or housing, and having a plastic diamond attached to the housing by snap fastener elements, that is, a head a socket. The slider of the invention may be readily assembled or disassembled without the use of tools. Further, a diamond of the slider under the invention includes an integral locking arch which arches up from the diamond and then down over the diamond or plow and engages between slide fastener elements on the associated stringers. The invention also includes a flexible pull having a crosspiece disposed under the locking arch and an anchoring end disposed between a pair of narrowing flanges in an extension of the snap fastener socket described above. The spacing of the parts is such that pulling force on the slide fastener pull will be borne by the locking arch to unlock the slider and that excessive pulling force is transmitted by the anchoring end to the slider diamond, saving the locking arch from undue stress.

BRIEF DESCRIPTION OF THE DRAWING

Other features and objects of the invention will be apparent from a reading of the following specification, including the drawings, all of which disclose a nonlimiting embodiment of the invention. In the drawings.

DESCRIPTION OF THE PREFERRED EMBODIMENT

Figure 1:
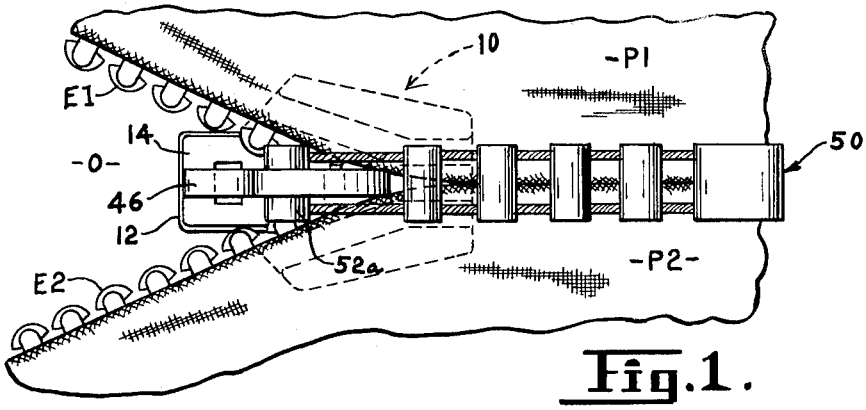
FIG. 1 is a top plan view of a slide fastener embodying the invention as installed on a garment and showing the slider body partly in phantom.
Figure 7:
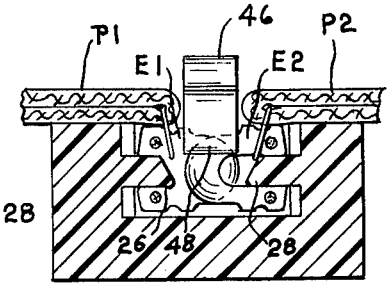
FIG. 7 is a sectional view taken on the line 7—7 of FIG. 3.

Referring more specifically to the drawings, a slide fastener slider embodying the invention is shown in FIG. 1 installed on a slide fastener in the opening "O" between two panels P1 and P2 of a garment. As shown in FIG. 7, the margins of the opening "O" are folded under, and stitched thereto are the lines of fastener elements E1 and E2. This arrangement is all as described in the aforementioned Cuckson et al patent. In engagement with and disposed for movement along the fastener elements is the slider which embodies the invention. The slider is generally designated 10 in FIG. 1, wherein the slider body is partially hidden.

Figure 2:
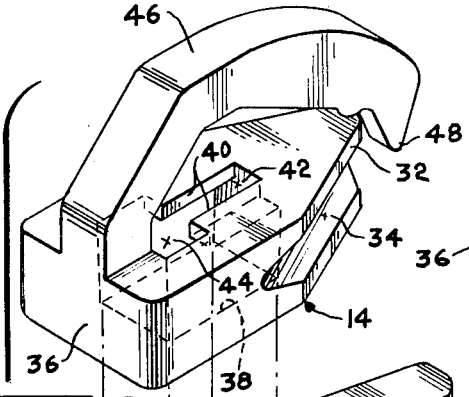
FIG. 2 is an enlarged exploded perspective view showing the body or housing and diamond or plow of the slider embodying the invention.
Figure 3:
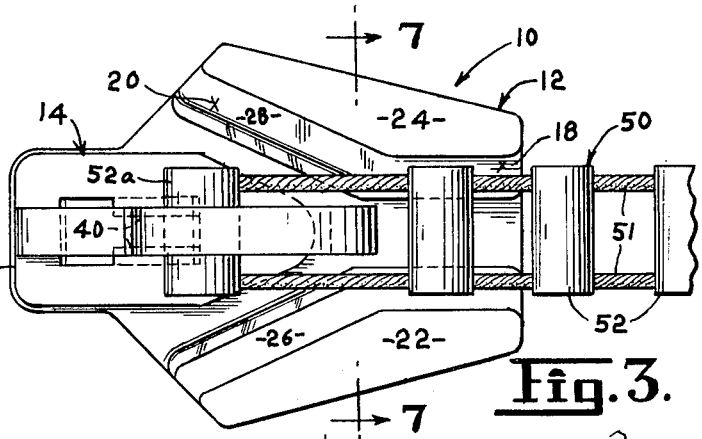
FIG. 3 is a top view of a slider embodying the invention and including its pull tab show in fragmentary fashion.

The slider (FIG. 2) includes a body or housing 12 and a diamond or plow 14. The body or housing 12 comprises a Y-shaped back plate 16 which features a throat 18 and a flaring mouth 20. The back plate includes the side flanges 22, 24 which are shaped and present longitudinal inward tongues 26, 28 which respectively engage the outwardly-facing openings in the fastener elements as shown in FIG. 7.

Figure 5:
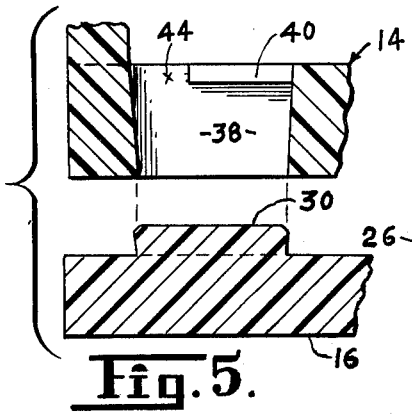
FIG. 5 is a fragmentary sectional view taken on the line 5—5 of FIG. 2.
Figure 6:
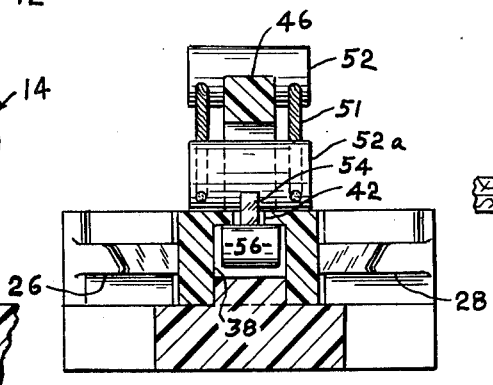
FIG. 6 is a sectional view taken on the line 6—6 of FIG. 4.

Rising from the floor of the back plate 16 is a rectangular head 30 which, as best shown in FIG. 5, has outwardly slanting side walls so that the top of the head 30 is somewhat wider than its base.

In the preferred form, the slider body 12 is of molded plastic material such as Nylon 66, a nitrogen-containing condensation polymer.

The diamond or plow 14 has a wedge-shaped end 32 with grooves 34 adapted to receive and guide the heads of the fastener elements, and the rear end of the diamond is block-shaped as at 36, and a socket 38, also of generally rectangular configuration, is formed in the body of the diamond from top to bottom. At the upper end of the opening 38 there are formed inward flanges 40 which leave a narrow slot 42 running longitudinally of the diamond as access to the opening 38. As can be seen from FIG. 2, the flanges terminate forwardly and leave an aperture the width of the opening 38 as at 44.

In the preferred version, the diamond or plow 14 is also formed of Nylon 66.

Integrally molded with the body of the diamond 14 is a locking arch 46 which extends upward from the rear of the diamond and arches forward to a position ahead of the front end 32 whereat the distal end of the arch 46 forms a locking tip 48 adapted to engage between fastener elements of the slide fastener. As shown best in FIG. 4, the underside of the locking arch 46 preferably presents a pair of oppositely slanting surfaces **46*a* and 46*b* for reasons which will appear. The underside of the arm 46 in the lower area of surface 46*b* is formed with a downward hump 46*c* to serve as a downward stop as it engages the top of the end 32** of the diamond as the arch is pressed downward, for instance, in a laundry operation.

A final element of the preferred embodiment is the flexible pull tab 50. This comprises a pair of rectangular cords 51 of cotton, plastic, or the like, about which are molded the opposite ends respectively of a series of spaced transverse elements 52 creating a rope-ladder-like structure. The transverse elements 52 may be of plastic such as Nylon 66 and are preferably cylindrical. They are appropriately spaced and the pull tab is sufficiently long as to afford a convenient grasp for the operator. The first of the transverse elements 52*a*, preferably larger in diameter than the other crosspieces 52, is disposed under the locking arch and the two cords 51 are disposed on either side of arch 46 for reasons which will appear. From a central location in the transverse element 52*a*, a molded integral connection strand 54 extends forwardly and terminates in an anchoring end comprising enlargement 56. As shown, the strand 54 extends through the opening 42 intermediate its opposing side flanges 40 and the anchoring end 56 is thereby locked in the opening 38, its escape prevented by the narrow side of the opening 42 with respect to the size of the anchoring element 56.

In assembly, as done manually or by machine, the body 12 is set on a flat surface and the diamond or plow 14 is brought over the flaring mouth of the body so that the opening 38 aligns with the head 30 and the pointed end 32 of the diamond faces the throat 18 of the slider body. The diamond is then shoved downwardly so that the head 30 is received snugly snap-fastener-fashion into the opening 38. If desired, a small amount of cement or the like may be used between the contiguous surfaces to permanently bond the parts together. The resulting structure is as shown in cross section in FIG. 4.

Also in assembly either prior to or subsequent to the aforementioned step, a pull tab as described is produced and the crosspiece 52*a* is maneuvered under the arch 46 with the arch disposed between the cords 51. The anchoring end 56 is then maneuvered into the opening 44 (FIG. 2) and is permitted to fall into the opening. The tab is then drawn rearwardly so that the anchoring end 56 is disposed under the flanges 40 and trapped thereby as as described.

OPERATION

Figure 4:
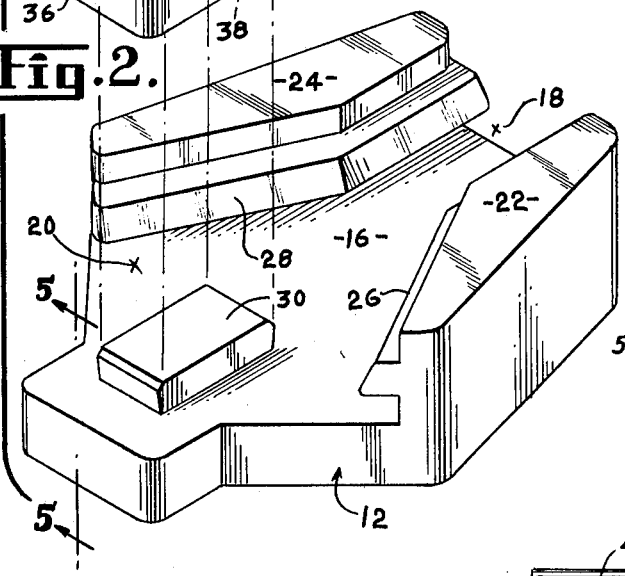
FIG. 4 is a side elevational view, partly in section, showing the locking arch and pull tab in full lines in a locked position and showing the locking arch and pull tab in unlocked or operating position in phantom.
Figure 4:
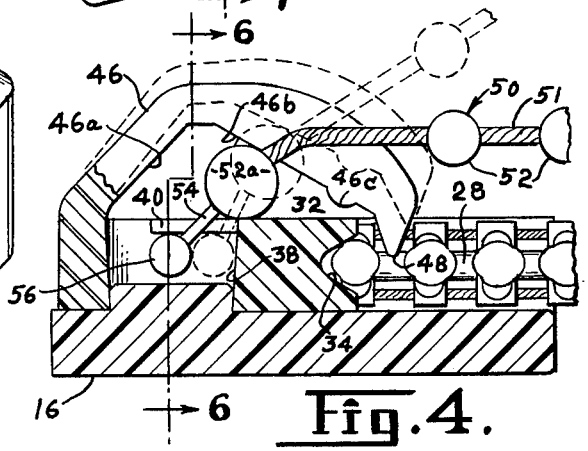

The operation of a slider embodying the invention is more or less conventional. Assuming the mounting of the slider on the interfitting lines of fastener elements E1 and E2, the tab 50 may be utilized conventionally. Specifically, when it is desired to open the fastener, the pull tab is pulled in the direction shown in phantom in FIG. 4 so that the crosspiece 52*a*, moving rightwardly as shown in FIG. 4, engages the top of end 32 and the slanting cam surface 46*b* and urges upwardly the distal end of the arch 46. This results in the raising of the tip 48 from the lines of fastener elements so that a further pull on the slider produces movement of the slider rightwardly, as shown in FIG. 1, opening the slide fastener.

As described, the pull force on the pull 50 is borne up to a limit by the arch 46 as described above. Beyond the limit, the excess force is borne directly by the slider body as the anchoring end 56, disposed under the flanges 50, butts against the side of the opening 38 as shown in FIG. 4. When the slider has reached its intended destination on the lines of fastener elements, the pull 50 is released by the operator and the arm 46 goes back to its natural position where the tip 48 engages between adjacent fastening elements, locking the slider on the slide fastener in the position selected.

In the closing operation, the pull tab 50 is pulled toward the left, as shown in FIG. 4, so that the crosspiece 52*a* engages under the slanting surface 46*a* here again to raise the distal end of the arch 46, removing the tip 48 from a position blocking movement of the fastener, toward a leftward direction as shown in FIG. 1. In this operation, the anchoring end 56 remains in the opening 38.

It will now be seen that the slider that we have disclosed is readily manufactured from elements of molded plastic and readily assembled. Its operation includes an effective locking mechanism which is conveniently and naturally operated by the mere release of the slider pull tab. Special provisions are disclosed for avoiding the overtaxing of the locking arm by providing an anchoring end between the flanges 40.

Having thus described our invention, we would have it clear that the invention is not limited to the only embodiment disclosed but should be limited only by the following claim language or equivalents thereof:

We claim:

1. A slide fastener slider for invisible-type slide fasteners, the slider having a body comprising a back plate of flaring shape and with side arms, and a diamond, the diamond at least being formed of resilient plastic material, the lower end of the diamond being disposed against the central portion of the floor of the back plate, the lower surface of the diamond being formed with a socket element and the upper surface of the plate being formed with an integrally formed head element, the two elements being interengaged to hold the diamond on the back plate, the undersurface of the plate presenting a smooth projection-free surface, the diamond being formed with an integral locking arm extending up and out from the upper surface thereof and arching down toward the narrow end of the back plate and terminating in a locking tip adapted to engage fastener elements.

2. A slide fastener slider as claimed in claim 1 wherein a pull tab is connected to the slider and has a cross portion disposed under the locking arm, whereby a pull on the tab raises the distal end of the arm away from the slider to move the tip away from the elements.

3. A slide fastener slider as claimed in claim 1 wherein the socket has the shape of a generally rectangular opening and the upper end of the opening at the upper end of the diamond is formed with inward flanges narrowing the opening, and a pull tab is provided having an enlargement trapped in the opening by the flanges but free for some movement lengthwise of the slider in the opening, the tab also having a cross portion disposed under the locking arm, the freedom of the tab enlargement in the opening being sufficient when the tab is pulled to permit the cross portion to engage the arm to raise the tip away from the elements.

4. A slide fastener slider as claimed in claim 3 wherein the pull tab is a flexible ladder-like structure being formed of flexible side cords and relatively rigid crosspieces and the said cross portion is one of the crosspieces.

5. A slide fastener slider as claimed in claim 1 wherein the side arms are formed therealong with inward tongues to engage in outwardly-facing U-shaped openings in fastener elements.

6. A slide fastener slider comprising a unitary housing with a Y-shaped throat and side flanges adapted to engage lines of fastener elements, and an opening wedge of resilient plastic material having its lower end disposed on the center line of the housing, one of the housing and wedge being formed with an opening in the contiguous areas of the housing and wedge and an integral head being formed on the other of the housing or wedge, the head and opening being interengaged with the head entirely within the opening to secure the wedge and housing firmly together, the wedge being formed with an integral resilient locking arm having a distal end adapted to engage the fastener elements to assist in locking the slider in a selected position on the lines of fastener elements, and a pull tab having a portion passing under the arm.

7. A slide fastener slider for an invisible zipper comprising a body having a plastic plow with an integral locking arm, the plow being formed with an opening in its upper end, the margins of the opening being formed with inward flange means, a pull tab having an enlarged anchor end, the end having disposed in the opening and trapped therein by the inward flange means, the tab having a crosspiece disposed under the arm, the distance on the pull tab between the anchor end and the crosspiece being such that a pull on the pull tab will be borne by the locking arm as the crosspiece engages it to result in an unlocking movement of the arm, but the engagement of the anchor end with the flange means upon the flexure of the arm to a predetermined point prevents further flexure and overstress of the arm.

8. A slide fastener slider as claimed in claim 7 wherein the opening extends vertically through the plow and terminates downwardly in a socket, and the floor of the body has an upstanding head snugly engaging into the socket to hold the plow and body together.

9. A slide fastener slider as claimed in claim 8 wherein the body is also formed of a resilient plastic and the head is integrally molded therewith.

10. A slide fastener slider comprising a Y-shaped body having a plow of a resilient plastic material with an integral locking arm arching over the plow, the arm having a distal end adapted to lockingly engage the fastener elements, and a pull tab having an end anchored to the plow, the tab also having a crosspiece disposed between the plow and the arm and means permitting a pull force on the tab to be borne by the crosspiece working on the arm up to a limit, the excess over the limit being transmitted directly to the plow to avoid overstress of the arm.

11. A slide fastener slider as claimed in claim 10 wherein the body and plow are joined together by a head and socket structure, the head and socket being disposed respectively on the body and plow.

12. A slide fastener slider as claimed in claim 11 wherein the head is formed on the body and increases in cross section as its distal end is approached.

13. A slide fastener slider as claimed in claim 12 wherein the head and socket are rectangular in transverse cross section.

* * * * *